US005105739A

United States Patent [19]

Osawa et al.

[11] Patent Number: 5,105,739

[45] Date of Patent: Apr. 21, 1992

[54] APPARATUS FOR CONTROLLING INK SUPPLY AMOUNTS OF INDIVIDUAL ZONES

[75] Inventors: Fumio Osawa; Hideki Mori, both of Ibaraki, Japan

[73] Assignee: Komori Corporation, Tokyo, Japan

[21] Appl. No.: 275,327

[22] Filed: Nov. 23, 1988

[51] Int. Cl.[5] ..... B41F 31/02

[52] U.S. Cl. ..... 101/365; 101/DIG. 47

[58] Field of Search ..... 101/365, DIG. 47; 318/685, 696

[56] References Cited

U.S. PATENT DOCUMENTS

| | | | |
|---|---|---|---|
| 4,329,923 | 5/1982 | Iida | 101/365 |
| 4,591,774 | 5/1986 | Ferris | 318/696 |
| 4,761,598 | 8/1988 | Lovrenich | 318/685 |

*Primary Examiner*—David B. Wiecking
*Assistant Examiner*—Steven S. Kelley
*Attorney, Agent, or Firm*—Remy J. VanOphem

[57] ABSTRACT

An apparatus for controlling ink supply amounts of individual zones by independently controlling gaps between an ink fountain roller and blades, the zones being obtained by dividing an axial length of a printing plate, includes a stepping motor arranged to correspond to each blade, a pulse generator directly coupled to the stepping motor, a waveshaper consisting of two AND gates and arranged in correspondence with the pulse generator, and a control unit including a CPU, an interface, and a memory. The stepping motor increases or decreases the gap between each blade and the ink fountain roller. The pulse generator generates two-phase pulse-like signals upon rotation of the stepping motor. The waveshaper waveshapes the pulse-like signals into two-phase pulse signals in accordance with hysteresis characteristics. The control unit supplies drive pulses to the stepping motor and detects that a control error of the stepping motor occurs when the pulse signals are not normally generated by the waveshaper in response to the drive pulses.

3 Claims, 2 Drawing Sheets

APPARATUS FOR CONTROLLING INK SUPPLY AMOUNTS OF INDIVIDUAL ZONES

BACKGROUND OF THE INVENTION

The present invention relates to an apparatus for controlling ink supply amounts of individual zones obtained by dividing an axial length of a printing plate mounted on a plate cylinder in a printing press.

In a conventional printing press, blades corresponding to the individual zones of the printing plate are disposed opposite to an ink fountain and an ink fountain roller which are used to continuously supply optimal amounts of ink to the printing plate mounted on the plate cylinder. Gaps between the ink fountain roller and the respective blades are independently adjusted in accordance with an image pattern on the printing plate, and the amounts of ink supplied to the individual zones are determined. This operation is performed by remote control. For this purpose, gap adjusting motors are arranged for the blades, respectively, and potentiometers are also arranged to convert gaps into electrical signals. Gap signals are supplied to feedback signals to a DC servo control circuit, thereby controlling the ink supply amounts of the individual zones.

With the above arrangement, control precision and stability are insufficient due to durability of servo motors and potentiometers, their deterioration over time, variations in impedances of connecting wires, and electrical noise.

In order to eliminate the above drawbacks, stepping motors and a digital control circuit can be used to perform open or closed loop control in place of the above analog control.

In open loop control, however, when each stepping motor cannot be rotated in synchronism with drive pulses and becomes out of step, amounts of ink cannot be appropriately supplied. In the worst case, such control becomes inaccurate or impossible, resulting in defective printing. Therefore, it is necessary to use closed loop control.

A control origin is detected by a sensor, and control is performed in accordance with the detected control origin. Alternatively, a gap between the blade and the ink fountain roller is detected as an electrical signal in the same manner as in the conventional technique, or a rotational condition of each motor is detected by a rotary encoder or the like, and a detection output is used as a feedback signal.

In closed loop control, when the control origin is detected by the sensor, control values excluding the original control value are not given by closed loop control. The out-of-step state of the stepping motor cannot be detected. When the potentiometer is used, its durability is degraded because it has mechanical contacts. At the same time, detection precision is limited, and high-stability, high-precision control is impossible. When the rotary encoder or the like is used, the out-of-step state of the stepping motor causes rotational torque pulsation and hunting. A hunting pulse is generated by the rotary encoder or the like. A count of the rotary encoder becomes inaccurate, and a control error occurs.

SUMMARY OF THE INVENTION

It is an object of the present invention to provide an apparatus for controlling ink supply amounts of individual zones by using stepping motors, wherein an out-of-step state of each stepping motor can be accurately detected.

It is another object of the present invention to provide an apparatus for controlling ink supply amounts of individual zones by using stepping motors, wherein a high-precision, high-stability control state can be obtained.

In order to achieve the above objects of the present invention, there is provided an apparatus for controlling ink supply amounts of individual zones by independently controlling gaps between an ink fountain roller and blades, the zones being obtained by dividing an axial length of a printing plate, a stepping motor, arranged to correspond to each blade, for increasing/decreasing the gap between each blade of the ink fountain roller, a pulse generator, directly coupled to the stepping motor, for generating two-phase pulse-like signals upon rotation of the stepping motor, a waveshaper, arranged in correspondence with the pulse generator, for waveshaping the pulse-like signals into pulse signals in accordance with hysteresis characteristics, and control means for supplying drive pulses to the stepping motor and detecting that a control error of the stepping motor occurs when the pulse signals are not normally generated by the waveshaper in response to the drive pulses.

When each stepping motor is rotated in response to drive pulses, two-phase pulse-like signals are generated by the pulse generator. The pulse-like signals are waveshaped into two-phase pulse signals by the waveshaper. Therefore, normal rotation of each stepping motor can be detected by these two-phase pulse signals. In addition, since the waveshaper has hysteresis characteristics, the out-of-step state of each stepping motor does not cause hunting in the output pulses from the waveshaper even if hunting occurs in the pulse-like signals from the pulse generator. In this case, the signals from the waveshaper are two-phase pulses, so that a rotational direction of the stepping motor can be detected. A wrong rotational direction can be accurately detected, and a control error of the stepping motor can be immediately detected.

DETAILED DESCRIPTION OF THE PREFERRED EMBODIMENT

The present invention will be described in detail with reference to a preferred embodiment in conjunction with the accompanying drawings.

Figure 1:
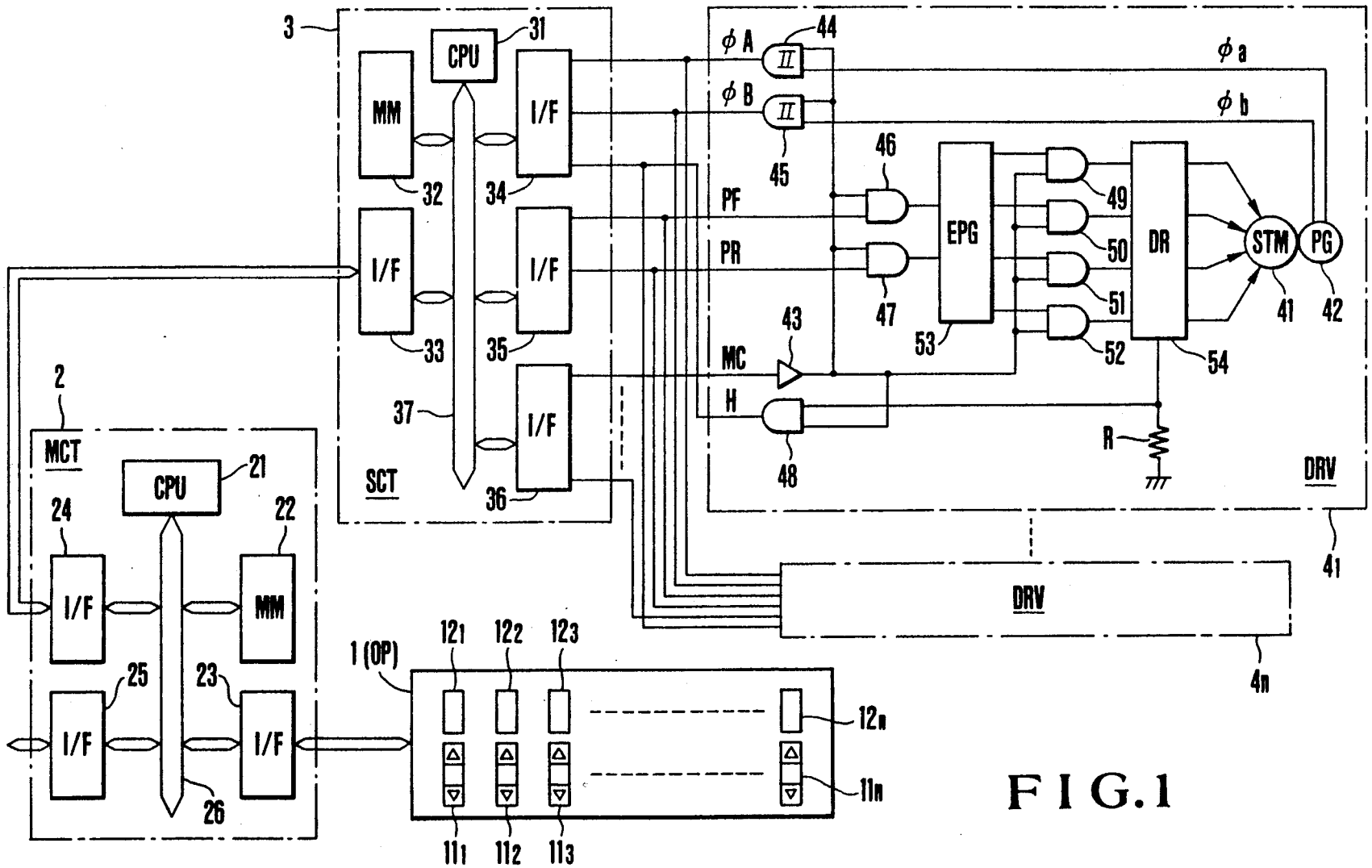
FIG. 1 is a block diagram of an apparatus for controlling ink supply amounts of individual zones according to an embodiment of the present invention.

Referring to FIG. 1, blade gap adjusting switches $\mathbf{11}_l$ to $\mathbf{11}_n$ respectively corresponding to zones obtained by dividing an axial length of a printing plate are arranged in an operation panel (to be referred to as an OP hereinafter) 1. Indicators $\mathbf{12}_l$ to $\mathbf{12}_n$ such as bar indicators are arranged above the switches $\mathbf{11}_l$ to $\mathbf{11}_n$ so as to oppose the switches $\mathbf{11}_l$ to $\mathbf{11}_n$, respectively. The indicators $\mathbf{12}_l$ to $\mathbf{12}_n$ indicate gaps between the ink fountain roller and the blades. A main control unit (to be referred to as an MCT hereinafter) 2 connected to the OP 1 includes a processor such as a microprocessor (to be referred to as a CPU hereinafter) 21 as a major component, a memory (to be referred to as an MM hereinafter) 22 consisting of a ROM (Read-Only Memory) and a RAM (Random Access Memory), and interfaces (to be referred to as I/Fs hereinafter) 23 to 25, all of which are connected through a bus 26. The CPU 21 executes instructions stored in the ROM in the MM 22 and performs predetermined data processing while storing/reading out necessary data in/from the RAM in the MM 22.

A subcontrol unit (to be referred to as an SCT) 3 connected through the I/F 24 in the MCT 2 includes a CPU 31 similar to the CPU 21, an MM 32 similar to the MM 22, and I/Fs 33 to 36. The CPU 31, the MM 32, and the I/Fs 33 to 36 are connected through a bus 37. The CPU 31 performs predetermined control in the same operations as in the CPU 21.

Drive units (to be referred to as DRVs hereinafter) $4_l$ to $4_n$ are arranged for the blades of the ink fountain, respectively. These DRVs $4_l$ to $4_n$ correspond to the indicators $12_l$ to $12_n$, respectively. The DRVs are represented by the DRV $4_l$, as shown in FIG. 1. The DRV $4_l$ includes a stepping motor (to be referred to as an STM hereinafter) 41 for controlling a gap between the ink fountain roller and a corresponding blade, and a pulse generator (to be referred to as a PG hereinafter) 42 directly connected to the STM 41. When a selection signal MC output from the I/F 36 in the SCT 3 is supplied to the DRV $4_l$ through a buffer 43, AND gates 46 to 52 are turned on. A driver (to be referred to as a DR hereinafter) 54 is driven by a forward or reverse rotation pulse PF or PR output from the SCT 3 through the I/F 35 in the SCT 3 in accordance with an excitation signal generated by an excitation pattern generator (to be referred to as an EPG hereinafter) 53. Therefore, the DR 54 causes a stepwise rotation of the STM 41.

Upon rotation of the STM 41, the PG 42 is also rotated and generates two-phase pulse-like signals $\phi$ a and $\phi$b having the same phase difference (90° out of phase) as in a two-phase encoder. The two-phase pulse-like signals are waveshaped into two-phase pulse signals $\phi$A and $\phi$B by the AND gates 44 and 45 which serve as a waveshaper having hysteresis characteristics. The two-phase pulse signals $\phi$A and $\phi$B are supplied to the I/F 34 in the SCT 3.

A resistor R is inserted in a power source return path of the DR 54. A voltage generated across the STM 41 upon supply of a drive current is output as an excitation detection signal H to the I/F 34 in the SCT 3 through the AND gate 48.

When an increase/decrease in gap between each blade and the ink fountain roller is designated by selectively using the switches $11_l$ to $11_n$ in the OP 1, the input data is supplied to the CPU 21 through the I/F 23. The CPU 21 outputs through the I/F 24 data which designates the blade subjected to an increase/decrease in gap. This data is supplied to the CPU 31 through the I/F 33. The CPU 31 outputs the selection signal MC through the I/F 36 to select a DRV 4 to be controlled. The forward or reverse rotation pulses PF or PR, the number of which corresponds to an increase/decrease in gap, are output from the I/F 35. The STM 41 is driven through the EPG 53 and the DR 54. The STM 41 is rotated by the number of steps corresponding to the number of pulses and, therefore, the gap between the ink fountain roller and the corresponding blade can be adjusted.

Upon rotation of the STM 41, the PG 42 is rotated to output the pulse-like signals $\phi$a and $\phi$b representing a state of rotation and outputs the detection signal H upon application of a drive current from the DR 54. When the pulse signals $\phi$A and $\phi$B through the I/F 34 are normally generated, the CPU 31 determines that the out-of-step state of the STM 41 does not occur and a control state is normal. At the same time, the CPU 31 determines using the detection signal H that a driving state is normal. The SCT 3 determines whether an error occurs. If an error occurs, the SCT 3 sends an error signal to the MCT 2. The MCT 2 indicates an error in accordance with the error signal.

A blade gap indication on the OP 1 is given by a value designated by each of the switches $11_l$ to $11_n$.

The above control is repeatedly and sequentially performed in an order of DRV $4_l$ to $4_n$ at high speed. Control for the DRV $4_l$ to $4_n$ and indications on the indicators $12_l$ to $12_n$ are performed upon operations of the OP 1.

The I/F 25 is used for data exchange with other portions, and its data processing is performed by the CPU 21.

Figure 2:
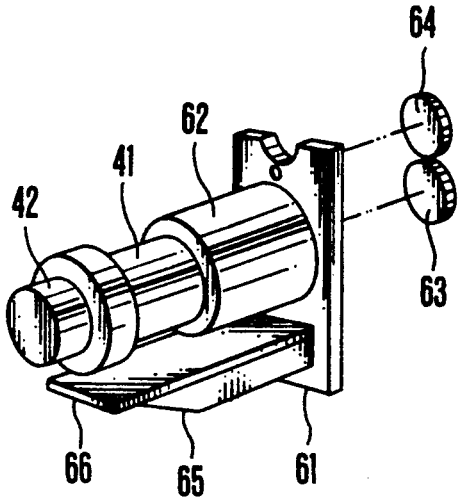
FIG. 2 is a perspective view showing a drive unit of the apparatus shown in FIG. 1.

FIG. 2 is a perspective view showing a structure of the DRV 4. The STM 41 is fixed on a mounting plate 61 through a reduction gear box 62. The PG 42 is directly coupled to the STM 41. A known blade gap adjusting mechanism (not shown) is driven through a gear 63 and a gear 64 meshed therewith. The gear 63 is mounted on a shaft extending through the mounting plate 61 of the gear box 62.

A support member 65 is fixed on the mounting plate 61 at a position opposite to the STM 41 and is parallel to the STM 41 and the like. A printed circuit board 66 having respective circuits of the DRV 4 shown in FIG. 1 thereon is locked so as to face the STM 41.

Figure 3:
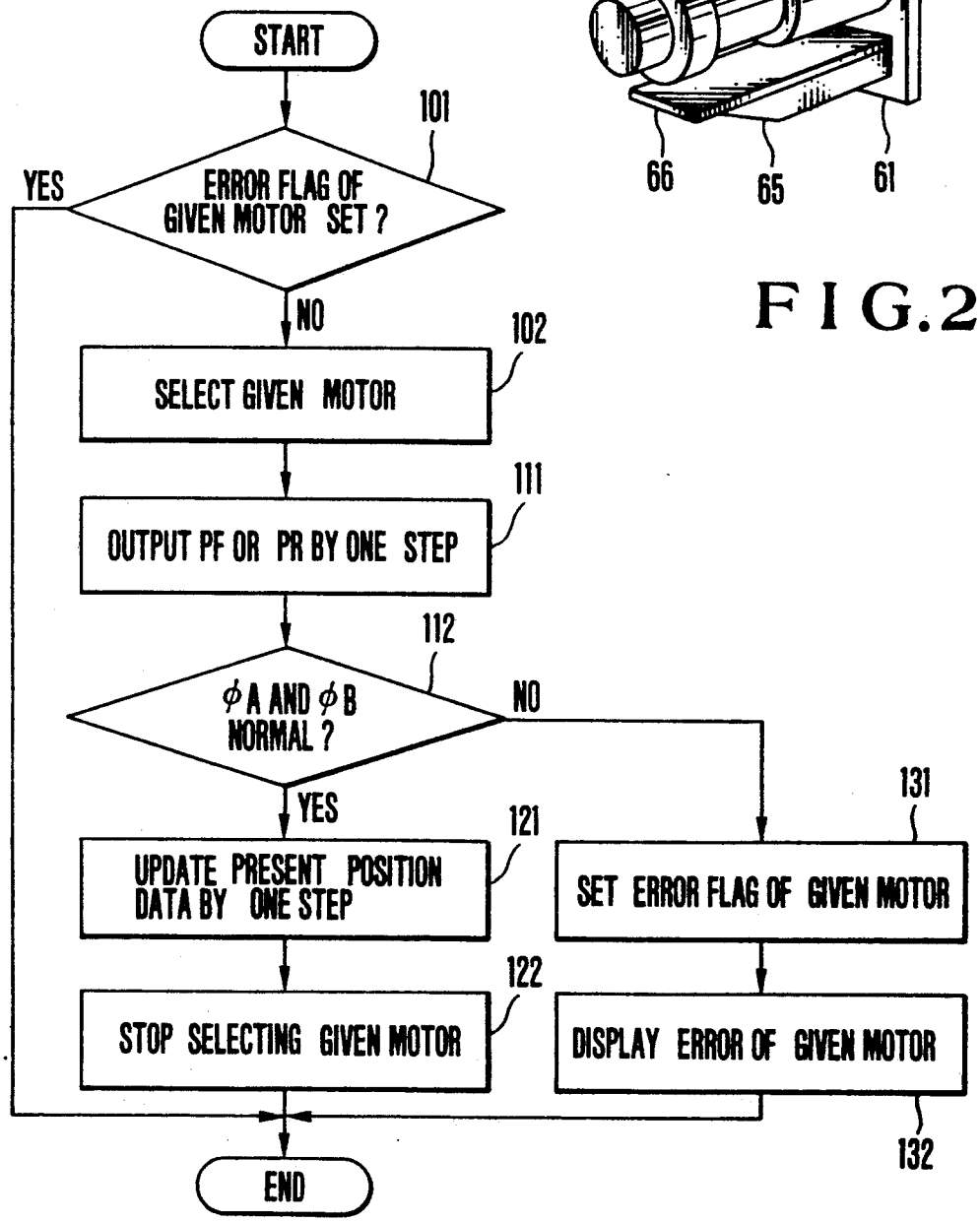
FIG. 3 is a flow chart for explaining control procedures.

FIG. 3 is a flow chart showing control procedures mainly executed by the CPU 31 in the SCT 3. Step 101 "ERROR FLAG OF GIVEN MOTOR SET? " is executed. If N (NO) in step 101, the selection signal MC is output and step 102 "SELECT GIVEN MOTOR" is executed. Step 111 "OUTPUT PF OR PR BY ONE STEP" is executed. Only the drive pulses, the number of which is required to rotate the STM 41 by one revolution, are output. Step 112 "$\phi$A AND $\phi$B NORMAL? " is executed to determine whether the pulse signals $\phi$A and $\phi$B through the AND gates 44 and 45 are normal.

If Y (YES) in step 112, step 121 "UPDATE PRESENT POSITION DATA BY ONE STEP" is executed to update the data in the MM 32. Step 122 "STOP SELECTING GIVEN MOTOR" is executed by disabling the selection signal MC. The same operations after step 101 are performed for the next STM 41 through "END".

However, if N in step 112, the pulse signals $\phi$A and $\phi$B are not normally generated, and the STM 41 is set in the out-of-step state. Step 131 "SET ERROR FLAG OF GIVEN MOTOR" is executed. At the same time, data representing an error is sent to the MCT 2, and step 132 "DISPLAY ERROR OF GIVEN MOTOR" is executed. Flickering or a change in indication color of a corresponding indicator 12 on the OP 1 is performed, thereby signaling a control operation failure to an operator.

Since the out-of-step state of the STM 41 can be immediately and accurately detected and can be immediately signaled to the operator, an appropriate procedure can be taken prior to production of a large amount of defective printed matter caused by a control error in ink supply amounts.

Since the PG 42 generates the two-phase pulse-like signals $\phi a$ and $\phi b$, the out-of-step state of the stepping motor can be accurately detected even if a hunting pulse is generated.

The two-phase pulse signals $\phi A$ and $\phi B$ are used for detection of only the out-of-step state of the stepping motor. Therefore, this control scheme is not open loop control, and no control errors caused by noise or the like are generated. Even if the STM 41 is forcibly rotated by an external force, the pulse signals $\phi A$ and $\phi B$ represent a rotational direction and a rotational angle. Therefore, a positional error can be obtained by comparing the detected rotational direction and angle with preset data in the MM 32, thereby arbitrarily correcting the positional error.

The STM 41 does not have any brush, and the PG 42 does not have any mechanical contacts unlike in a potentiometer or the like. Durability and stability of the apparatus as a whole can be improved, and high reliability can be assured.

If gap control is accurate due to use of the STM 41 and the number of steps of the STM 41 is 10 times or more a minimum command unit, control precision and reproducibility can be improved. At the same time, the control origin of the DRV 4 does not have any mechanical limitations. Therefore, a control origin can be set independently of the blade gap adjusting mechanism.

Since the PG 42 is directly coupled to the STM 41, generation of the pulse-like signals $\phi a$ and $\phi b$ upon rotation of the STM 41 is not delayed, and high-speed detection based on these pulse-like signals can be achieved.

The STM 41 may be an ultrasonic driven motor, and the PG 42 may be a photoelectric pulse encoder to obtain the same effect as in the above embodiment. The printed circuit board 66 in FIG. 2 may be omitted, and a printed circuit board may be incorporated in the SCT 3 in FIG. 1. Various changes and modifications of the arrangements in FIGS. 1 and 2 can be made in accordance with selected conditions.

The present invention is also applicable to plate registration and paper size presetting in a printing press with slight modifications.

According to the present invention as has been described above, when the ink supply amounts of individual zones are controlled by the stepping motors on the basis of the gaps between the ink fountain roller and the blades, the out-of-step states of the stepping motors can be independently detected, and the high-precision, high-stability control state can be achieved. Various effects can be obtained in control for ink supply amounts of the individual zones in various printing presses.

What is claimed is:

1. An apparatus for controlling ink supply amounts of individual zones by independently controlling gaps between an ink fountain roller and blades, the zones being obtained by dividing an axial length of a printing plate, said apparatus comprising:

a stepping motor associated with each of said blades, said stepping motor displacing its associated blade to increase/decrease the gap between said associated blade and said ink fountain roller;

a pulse generator directly coupled to each of said stepping motors, said pulse generator generating two-phase pulse-like signals in response to each step rotation of said stepping motor to which it is coupled;

a waveshaper having hysteresis characteristics, electrically connected to each pulse generator, said waveshaper generating two-phase pulse signals from said two-phase pulse-like signals; and control means having means for supplying drive pulses to said stepping motor and means for detecting that a control error of said stepping motor occurs when said pulse signals are not normally generated by said waveshaper in response to each drive pulse received by said stepping motor.

2. An apparatus according to claim 1, wherein said waveshaper comprises two AND gates for waveshaping said two-phase pulse-like signals into said two-phase pulse signals.

3. An apparatus according to claim 2, wherein said control means includes a central processing unit, an interface, and a memory for storing reference rotational direction and angle data, said central processing unit having means for comparing reference rotational direction and angle data with detected rotational direction and angle data which are represented by said two-phase pulse signals received through said interface, thereby detecting an arbitrary positional error when said detected rotational direction and angle data generated in response to each drive pulse do not agree with said reference rotational and angle data.

* * * * *